US007918094B2

(12) United States Patent
Williams et al.

(10) Patent No.: US 7,918,094 B2
(45) Date of Patent: Apr. 5, 2011

(54) CENTRIFUGAL BERNOULLI HEAT PUMP

(75) Inventors: Arthur R. Williams, Holden, MA (US); Charles Agosta, Harvard, MA (US)

(73) Assignee: MachFlow Energy, Inc., Worcester, MA (US)

( * ) Notice: Subject to any disclaimer, the term of this patent is extended or adjusted under 35 U.S.C. 154(b) by 776 days.

(21) Appl. No.: 11/908,130

(22) PCT Filed: Mar. 9, 2006

(86) PCT No.: PCT/US2006/008428

§ 371 (c)(1),
(2), (4) Date: Sep. 8, 2007

(87) PCT Pub. No.: WO2006/099052

PCT Pub. Date: Sep. 21, 2006

(65) Prior Publication Data

US 2009/0277192 A1 Nov. 12, 2009

Related U.S. Application Data

(60) Provisional application No. 60/659,995, filed on Mar. 9, 2005.

(51) Int. Cl.
*F25B 9/00* (2006.01)

(52) U.S. Cl. ..... 62/87; 62/324.2; 62/401

(58) Field of Classification Search ..... 62/87, 324.1, 62/324.2, 238.7, 401, 467, 515; 165/121, 165/104.17, 104.19, 104.21, 125; 361/687, 361/676, 679.33

See application file for complete search history.

(56) References Cited

U.S. PATENT DOCUMENTS

| | | | |
|---|---|---|---|
| 2,223,429 | A | 12/1940 | Smith et al. |
| 2,544,299 | A | 3/1951 | Damon et al. |
| 2,857,332 | A | 10/1958 | Tenney et al. |
| 3,010,799 | A | 11/1961 | Ecal |
| 3,049,891 | A | 8/1962 | Barkelew |
| 3,200,607 | A | 8/1965 | Williams |

(Continued)

FOREIGN PATENT DOCUMENTS

| | | |
|---|---|---|
| DE | 698598 | 11/1940 |

(Continued)

OTHER PUBLICATIONS

Backhaus et al. "A thermoacoustic Stirling heat engine" Nature (1999), vol. 399, pp. 335-338.

(Continued)

*Primary Examiner* — Mohammad M Ali
(74) *Attorney, Agent, or Firm* — Bingham McCutchen LLP

(57) ABSTRACT

Heat pumps move heat from a source to a higher temperature heat sink. This invention enables spontaneous source-to-sink heat transfer. Spontaneous heat transfer is accomplished by conducting heat from the source through rotating disks to a portion of the generally warmer sink flow that is cooled to a temperature below that of the source by the Bernoulli effect. The nozzled flow required for Bernoulli cooling is provided by the corotating disk pairs. The distance between the opposing surfaces of the disk pair decreases with distance from the rotation axis, forming a nozzle. The heat-sink flow through the nozzle is maintained by centrifugal force caused by the circular motion of the gas near the disk surfaces. Embodiments of the invention differ in the paths followed by the source and sink fluid flows, by the number of disk pairs and by the state (gas or liquid.) of the heat source.

12 Claims, 8 Drawing Sheets

U.S. PATENT DOCUMENTS

| | | | | | |
|---|---|---|---|---|---|
| 3,334,026 | A | | 8/1967 | Bobell | |
| 3,344,051 | A | | 9/1967 | Latham | |
| 3,688,770 | A | | 9/1972 | O'Neill | |
| 3,791,167 | A | * | 2/1974 | Eskeli | 62/401 |
| 3,808,828 | A | | 5/1974 | Kantor | |
| 3,981,627 | A | | 9/1976 | Kantor | |
| 3,989,101 | A | | 11/1976 | Manfredi | |
| 4,362,473 | A | * | 12/1982 | Zeilon | 417/68 |
| 4,378,681 | A | | 4/1983 | Modisette | |
| 4,442,675 | A | * | 4/1984 | Wilensky | 60/654 |
| 5,255,520 | A | * | 10/1993 | O'Geary et al. | 62/3.2 |
| 5,275,006 | A | | 1/1994 | McCutchen | |
| 5,335,143 | A | | 8/1994 | Maling, Jr. et al. | |
| 5,412,950 | A | | 5/1995 | Hu | |
| 5,497,635 | A | * | 3/1996 | Alsenz | 62/502 |
| 5,520,008 | A | * | 5/1996 | Ophir et al. | 62/268 |
| 6,050,103 | A | * | 4/2000 | Ko | 62/401 |
| 6,050,326 | A | | 4/2000 | Evans et al. | |
| 6,089,026 | A | | 7/2000 | Hu | |
| 6,175,495 | B1 | | 1/2001 | Batchelder | |
| 6,179,573 | B1 | * | 1/2001 | Hablanian | 417/244 |
| 6,220,824 | B1 | * | 4/2001 | Hablanian | 417/245 |
| 6,394,747 | B1 | * | 5/2002 | Hablanian | 415/55.1 |
| 6,635,154 | B2 | | 10/2003 | Johnson et al. | |
| 6,651,358 | B2 | | 11/2003 | Giacobbe | |
| 6,659,169 | B1 | | 12/2003 | Lopatinsky et al. | |
| 6,684,822 | B1 | | 2/2004 | Lieggi | |
| 7,219,715 | B2 | * | 5/2007 | Popovich | 165/80.4 |
| 2003/0206796 | A1 | * | 11/2003 | Scholten | 415/1 |

FOREIGN PATENT DOCUMENTS

| | | |
|---|---|---|
| DE | 4103655 | 8/1992 |
| JP | 3-124917 | 5/1991 |

OTHER PUBLICATIONS

Tijani et al. "Prandtl number and thermoacoustic refrigerators" J. Acoust. Soc. Am. (2002) 112, pp. 134-143.

International Preliminary Report on Patentability for PCT/IB2006/002176 issued on Feb. 12, 2008.

International Preliminary Report on Patentability for PCT/US2005/021462 issued on Dec. 20, 2006.

International Preliminary Report on Patentability for PCT/US2006/008428 issued on Sep. 12, 2007.

International Preliminary Report on Patentability for PCT/US2006/024633 issued on Dec. 24, 2007.

International Search Report for PCT/IB2006/002176, mailed on Jan. 30, 2007.

International Search Report for PCT/US2005/21462, mailed on Apr. 7, 2006.

International Search Report for PCT/US2006/08428, mailed on Oct. 24, 2006.

International Search Report for PCT/US2006/24633, mailed on Jan. 17, 2007.

* cited by examiner

CENTRIFUGAL BERNOULLI HEAT PUMP

BACKGROUND OF THE INVENTION

1. Field of the Invention

The present invention relates to heat pumps, devices that move heat from a heat source to a warmer heat sink. More specifically, it relates to Bernoulli heat pumps.

2. Discussion of Related Art

Heat engines are devices that move heat from a source to a sink. Heat engines can be divided into two fundamental classes distinguished by the direction in which heat moves. Heat spontaneously flows "downhill", that is, toward lower temperatures. As with the flow of water, such "downhill" heat flow can be harnessed to produce mechanical work, as illustrated by internal-combustion engines, e.g. Devices that move heat "uphill", that is, toward higher temperatures, are called heat pumps. Heat pumps necessarily consume power. Refrigerators and air conditioners are examples of heat pumps. Common heat pumps employ a working fluid that transports heat by convection from the source to the sink. The temperature of the working fluid is varied over a range that includes the temperatures of the source and sink, so that heat will flow spontaneously from the source into the working fluid, and from the working fluid into the sink. The temperature variation of the working fluid is commonly effected by compression and expansion of the working fluid.

By contrast, Bernoulli heat pumps create the required temperature variation by converting random molecular motion (reflected in the temperature and pressure of the fluid) into directed motion (reflected in macroscopic fluid flow). A fluid spontaneously converts random molecular motion into directed motion when the cross sectional area of a flow is reduced, as when the flow passes through a nozzle. The variation in temperature and pressure with cross-sectional area is called the Bernoulli principle. Whereas compression consumes power, Bernoulli conversion does not. The energy-conserving character of Bernoulli conversion is the fundamental efficiency exploited by the Bernoulli heat pump.

While the creation of the working-fluid temperature variation exploited by the Bernoulli heat pump consumes no power, its exploitation to pump heat does require the power dictated by the Second Law of Thermodynamics. That is, when equal amounts of heat are added to and removed from the working fluid at different temperatures, the entropy of the working fluid is increased, and an amount of power proportional to the temperature difference must be supplied to restore the entropy. It is this entropy-restoration power that distinguishes the Bernoulli heat pump from a perpetual-motion machine. The ratio of the heat pumped to the work required to restore the entropy is the Carnot efficiency. This power consumption is quantitatively minor, as common heat pumps operate at less than 10% of Carnot efficiency. The more significant power consumption by Bernoulli heat pumps is that due to the entropy increase resulting from viscous dissipation in the boundary layer of the fluid flow. The challenge of Bernoulli heat pump technology is the minimization of these viscous losses.

The Bernoulli effect is well known, best known perhaps, as the basis for aerodynamic lift. Two U.S. patents (U.S. Pat. Nos. 3,049,891 and 3,200,607) describe devices designed to exploit Bernoulli conversion for the purpose of pumping heat. Both patents describe devices which use stationary nozzles to effect the required variation of the cross-sectional area of a fluid flow. Additionally, U.S. Pat. No. 3,049,891 is restricted to supersonic flow.

The present invention, also relates to the use of Ekman flow. Ekman flow is well known. It is discussed, for example, in Section 23 of "Fluid Mechanics" by L. D. Landau and E. M. Lifshitz (Pergamon Press, 1959). Ekman flow forms spontaneously near the surface of a spinning disk. The so-called no-slip property of gas-solid interfaces requires that the gas in the immediate vicinity of a spinning disk move with the disk. Unlike the solid comprising the disk, however, the gas spinning with the disk cannot withstand the concomitant centrifugal force. The resulting outward spiraling flow is called Ekman flow.

BRIEF SUMMARY OF THE INVENTION

The present invention uses pairs of rotating disks to create a Bernoulli heat pump. A heat pump transfers heat from a relatively cool heat source to a relatively warm heat sink. In the present invention, both the heat-source flow is either a gas or liquid; the heat-sink flow is a gas. The heat transfer takes place through an intermediary, one or more pairs of rotating disks that are good thermal conductors. The disks are in good thermal contact with both flows. In the present invention, the fundamental heat-pump action, that is, the transfer of heat from the cooler source to the warmer sink, occurs because rotation of the disk pairs creates a nozzled flow in which the local temperature in a region of the sink flow is below that of the source. The disks are in good thermal contact with both the source flow and the cold region of the sink flow, thereby enabling the flow of heat from the source to the sink. Local cooling of the heat-sink gas flow is caused by the Bernoulli effect.

An additional, but also well known, physical effect is exploited by the present invention, that of Ekman flow. Consider a single rotating disk. The so-called no-slip condition at the gas-solid interface requires that the gas in the immediate vicinity of the rotating disk rotate along with the disk. This rotation implies a centrifugal force acting on both the gas and the solid material comprising the disk. Unlike the solid material of the disk, however, the gas cannot withstand the centrifugal force, and moves radially outward. The resulting spiral flow of the gas is called Ekman flow. Ekman flow is confined to the vicinity of the surface of the spinning disk.

Disks, such as those used for the storage of digital information in computers, are traditionally planar. The present invention involves pairs of coaxial, but nonplanar, disks whose separation decreases with increasing distance ("r") from their common axis of rotation. If the disk separation at the outer edge of the two disks is sufficiently small, then the disk pair becomes a centrifuge pulling the gas through the circular nozzle created by the converging disks. In particular, if the separation between the disks decreases faster than 1/r, then the cross-sectional area of the radial flow decreases with increasing radius, the condition that creates the Bernoulli effect. [The cross-sectional area of the flow is the product of the circular perimeter and the disk separation. The perimeter is proportional to the radius r. Thus, if the disk separation decreases faster than 1/r, then the cross-sectional area decreases with radius.]

If the separation between two corotating disks decreases with increasing radius, the two disks form a nozzle through which the gas is pulled by centrifugal force. The Bernoulli effect lowers the temperature of the flowing gas in the neck of this nozzle. The present invention exploits this temperature lowering by allowing heat flow through the disk and into the nozzled gas flow, where the temperature of the gas flow allows forced convection to occur.

According to another aspect of the invention, the heat-sink gas flow may be segregated from the heat-source flow. Segregation allows, but does not require, the heat-sink flow to be closed, that is, repetitively cycling through the system, warming and cooling as it absorbs, transports and releases heat. Closed embodiments require an additional component, a heat sink to which the heat-sink gas flow transfers its acquired heat.

Open flows are convenient, but assume an unlimited supply of the heat-sink gas. This requirement usually translates into the working fluid being air. Closed systems allow the "working fluid" to be engineered and/or selected for its thermodynamic properties.

According to another aspect of the invention, the surface of the disks can be engineered to restrict heat transfer to regions of the disk-gas interface where the transfer is most efficient.

According to another aspect of the invention, a Bernoulli-Ekman heat pump may comprise multiple coaxially rotating disk pairs.

According to another aspect of the invention, a Bernoulli-Ekman heat pump may comprise multiple coaxially rotating disk pairs separated by materials that rotate with the disks or material that does not.

According to another aspect of the invention, a Bernoulli-Ekman heat pump may be used for the purpose of heating or cooling.

BRIEF DESCRIPTION OF THE DRAWINGS

The devices shown schematically in the figures are cylindrically symmetric. Therefore, cross sectional views in planes containing the rotation axis contain two identical diagrams. Figures labelled "radial-axial cross sectional view" show one of these two identical diagrams.

BRIEF DESCRIPTION OF THE REFERENCE NUMBERS

1. Thermally conducting, corotating disk pair.
2. Fluid entrance to the rotating hub.
3. Fluid exit of the rotating hub.
4. Neck of nozzle gas channel of the corotating disk pair.
5. Nozzling gas channel formed by corotating disk pair.
6. Axis of rotation of the disk-hub system.
7. Radial direction of increasing distance from rotation axis.
8. Wall of rotating hub to which the disks and annular turbines are mounted.
9. Annular turbines that sustain the axial fluid flow inside hub.
10. Axel of the rotating assembly of disks, hub and turbines.
11. Perforations in the duct wall connecting hub channel to inter-disk channel.
12. Portion of disk that is composed of a poor thermal conductor.
13. Heat-sink stator
14. Perforations in the disks near the hub connecting inter-disk channel to return-flow channel.
15. Return-flow portion of 5-4-15-14 toroidal-circulation channel.
16. Cylindrical duct that segregates source and sink fluid flows.
17. Coaxial channel carrying heat-sink fluid flow.
18. Solid material in region between adjacent disk pairs.

DETAILED DESCRIPTION OF THE INVENTION

Figure 1:
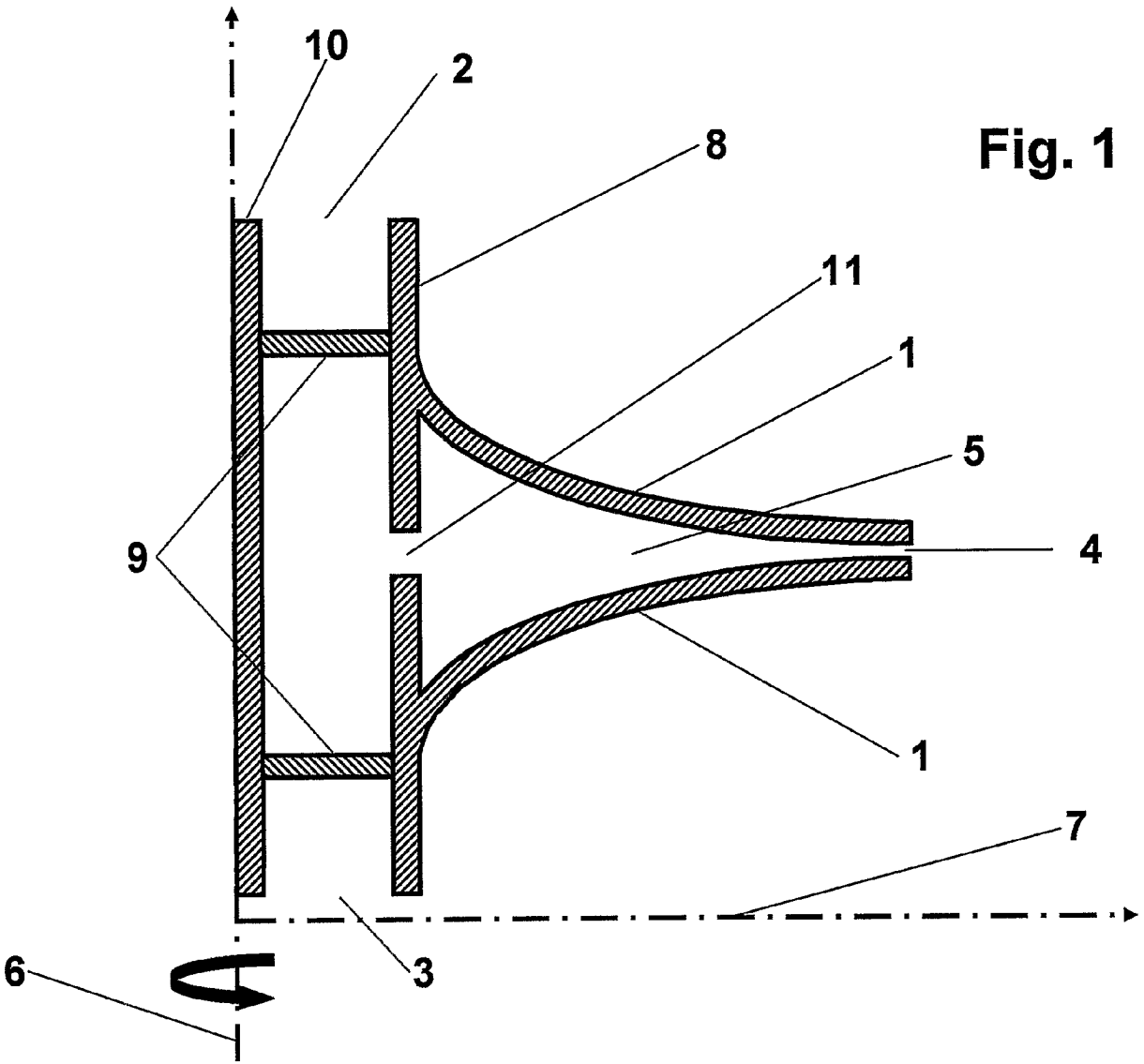
FIG. 1 is a radial-axial cross sectional view of a corotating disk pair comprising an open centrifugal Bernoulli heat pump according to an embodiment of the present invention.

In embodiments of the invention, such as that shown in FIG. 1, one or more coaxial, thermally conducting, corotating disk pairs 1 are mounted on a common hub 8 to create a heat pump. The disks comprising the disk pairs are not planar; they are shaped such that the distance between their opposing surfaces decreases with increasing distance from their common rotation axis. The corotating disk pair 1 acts as a centrifugal pump drawing the gas through the nozzle 5 formed by the converging surfaces of the corotating disk pair 1. Embodiments of the present invention require a motor which causes the hub-disk assembly to rotate about its rotation axis. The motor can be one of many possible types, including electric, internal combustion, wind-powered, etc.

The corotating disk pair acts as a centrifuge because of the so-called no-slip boundary condition obeyed by the gas at the gas-disk interface. That is, the gas in the immediate vicinity of a disk surface moves circularly with the disk. As a result of this circular motion, the matter comprising both the gas and the disk experience centrifugal force. Unlike the matter comprising the disk, the gas cannot resist the centrifugal force, and is accelerated outward, toward the periphery of the disk. The net result is a spiraling gas flow known as Ekman flow. The radial component of the spiral flow 4, 5, is nozzled by the decreasing disk separation. The nozzling in turn produces the local and ephemeral temperature reduction resulting from the Bernoulli effect.

Bernoulli conversion of thermal motion to directed motion requires that the cross-sectional area of the flow decrease along the flow. Considered as a function of radial position, this cross-sectional area is the product of the circular perimeter and the disk separation. Since the circular perimeter is proportional to the radius r, the disk separation must decrease faster than 1/r in order that the flow cross section decrease with increasing radius.

The disks 1 are good thermal conductors. Additionally, the inner (small-radius) portion of each disk is in good thermal contact with a heat-source fluid (gas or liquid) flow 2, 3. The outer (large-radius) portion of the disk is in good thermal contact with the portion 4 of the spiraling Ekman gas that is cooled by Bernoulli conversion. In this way, the disks thus provide a thermal-conduction path that connects the heat-source fluid flow 2, 3 to the heat-sink gas flow that has been locally 4 and ephemerally cooled by Bernoulli conversion. Heat flows spontaneously from the source fluid flow to the sink gas flow because the portion of the gas sink flow 4 that is in good thermal contact with the outer (large-radius) portion of the disk is locally at a lower temperature than the source fluid flow. When the spiraling flow leaves the region enclosed by the disk pair it slows and warms, as the Bernoulli effect converts directed molecular motion (flow) back into random thermal motion.

Embodiments of the invention are distinguished by the arrangement of heat-source and heat-sink flows, the number of disks pairs, and additional structures for controlling heat transfer and gas flows.

In open embodiments, the sink-gas flow carrying the transferred heat is exhausted. Open embodiments are illustrated in FIGS. 1, 3, 4, 7 and 8. In closed embodiments, such as that shown in FIG. 5, the toroidal recirculation of the heat-sink gas through regions 5, 4, 15 and 14 requires that the heat transferred to the heat-sink flow in region 4 be removed by transfer to an additional heat sink, such as the stator 13 shown in FIG. 5 Closed embodiments allow the material used for the heat-sink gas flow to be selected for desired thermal and viscous properties.

Figure 2:
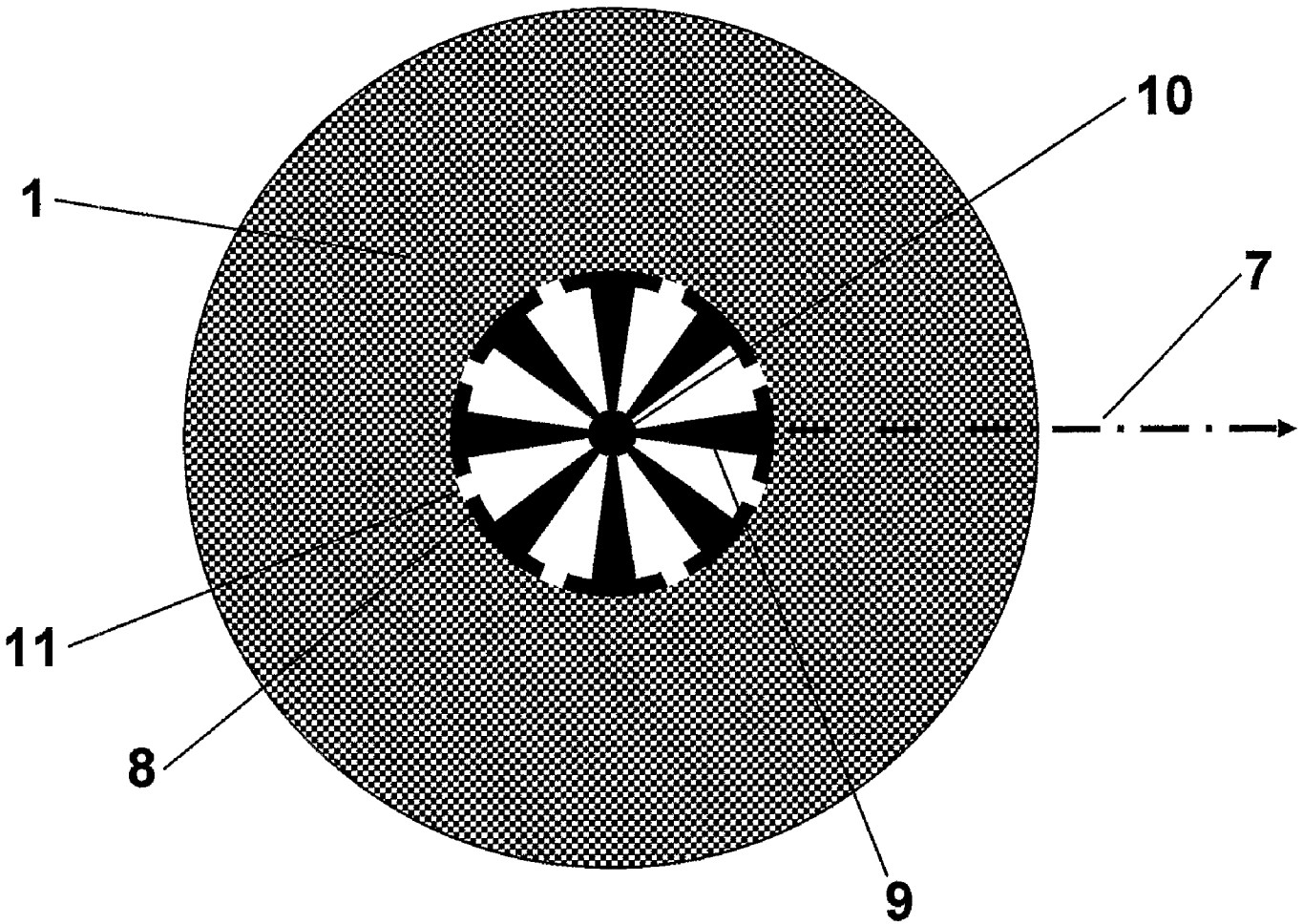
FIG. 2 is a top view of the corotating disk pair of FIG. 1.

A first embodiment, shown in FIGS. 1 and 2, is an open system comprising a single gas input and two gas outputs. The device separates a single gas flow into two output flows, one heated, the other cooled. As in all of the embodiments, this embodiment includes a thermally conducting, corotating disk pair 1 mounted on a common rotating hub 8. The hub 8 has a gas entrance 2 along its rotation axis 6. In this embodiment, the source and sink flows enter through a common duct entrance 2. In all embodiments, the heat-sink flow is a gas. Thus, because the source and sink flows enter this embodiment combined, the heat-source flow is also a gas. The combined source and sink flows move inside the hub 8, parallel to the rotation axis 6, propelled by one or more axial (annular) turbines 9. The gas flowing axially in the duct is cooled by the thermal connection between the duct and turbines and the portion of the heat-sink gas flow that is cooled by Bernoulli conversion. The thermal connection is provided by the thermally conducting disks. The cooled heat-source flow leaves the device through the exit 3 at the end of the hub 8 opposite the entrance 2. FIG. 2 is a top view of the combined disk-hub-turbine system.

The portion of the hub 8 between the corotating disk pair 1 is perforated. A portion of the gas entering at 2 and flowing axially inside the hub 8 leaves the hub radially through the perforations 11, thereby becoming the heat-sink flow in region 5. The corotating disk pair 1 acts as a centrifugal pump drawing the gas into the nozzle 5, 4 formed by the corotating disk pair 1.

Figure 3:
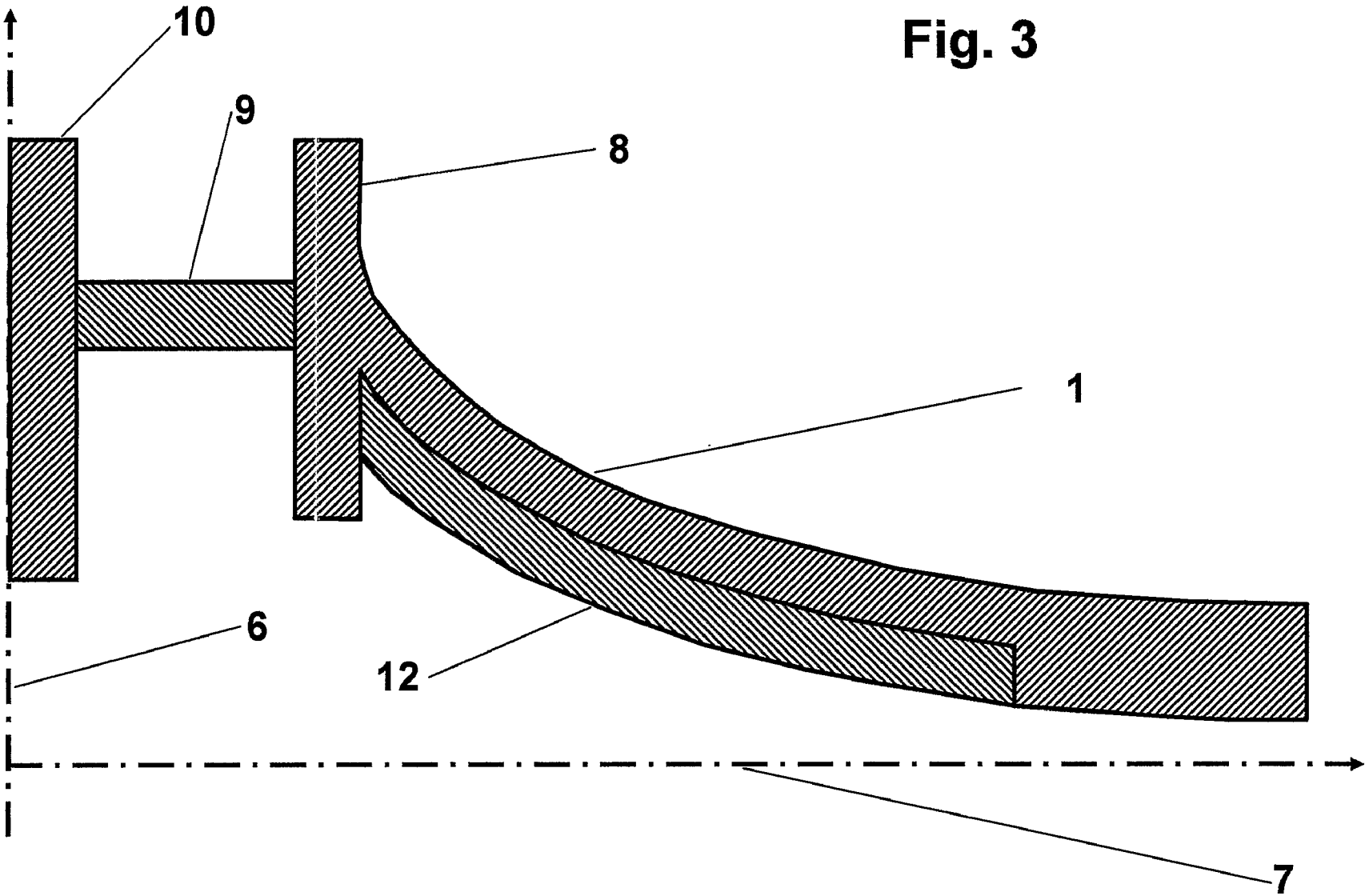
FIG. 3 is a radial-axial cross sectional view of a portion of one disk of one corotating disk pair comprising a restricted-heat-exchange centrifugal Bernoulli heat pump.

FIG. 3 illustrates a feature that can be used with all embodiments of the centrifugal Bernoulli heat pump. The portion of the surface area of the disks that is in good thermal contact with the heat-sink flow can be restricted. As illustrated by region 12 of FIG. 3, heat transfer from the disk to the heat-sink flow can be inhibited in regions of the disk surface where aspects of the transfer are less desirable than in other portions of the surface.

Figure 4:
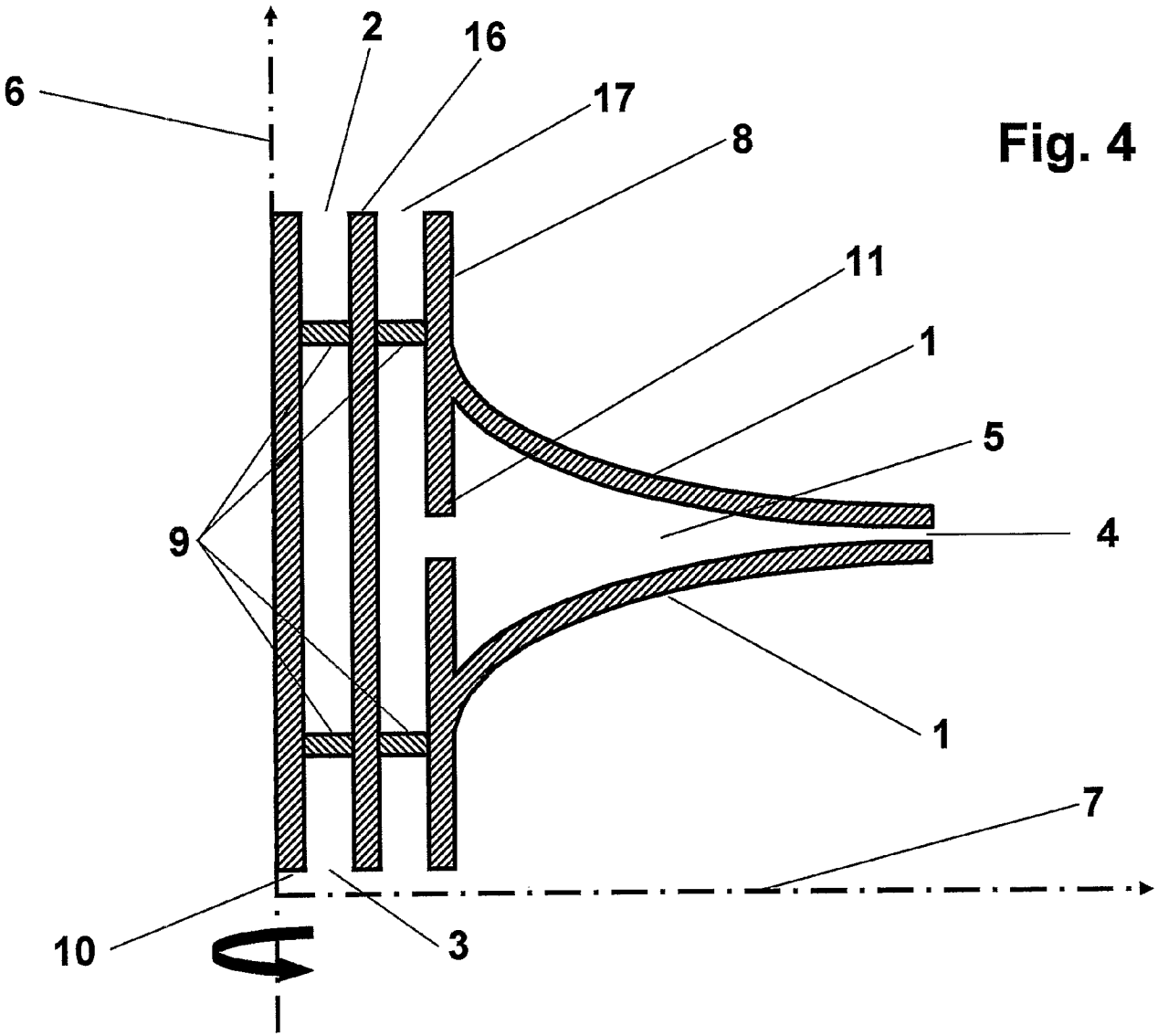
FIG. 4 is a radial-axial cross sectional view of the corotating disk pair comprising a segregated-flow centrifugal Bernoulli heat pump

FIG. 4 illustrates a third type of open embodiment, differing from that illustrated in FIG. 1 by the addition of a partition that segregates the heat-source and heat-sink flows. In FIG. 4, the partition is provided by the coaxial duct 16. For example, when the system is used for cooling, the sink flow can be comprised of exterior air, while the source flow can be interior air. When used for heating, interior air plays the role of heat-sink, while the exterior air provides the heat source. Segregation of the source and sink flows allows the two flows to be comprised of different materials. In particular, segregation allows the heat-source flow to be liquid. Additionally, source-sink segregation allows the heat-sink flow to be closed, that is, to recycle through the nozzle over and over again.

In open configurations, the heat transferred from the disks to the heat-sink flow is exhausted into the environment along with the heat-sink gas itself as it emerges from region 4 of the region between the corotating disk pair. Closed-system embodiments have no such exhaust.

Figure 5:
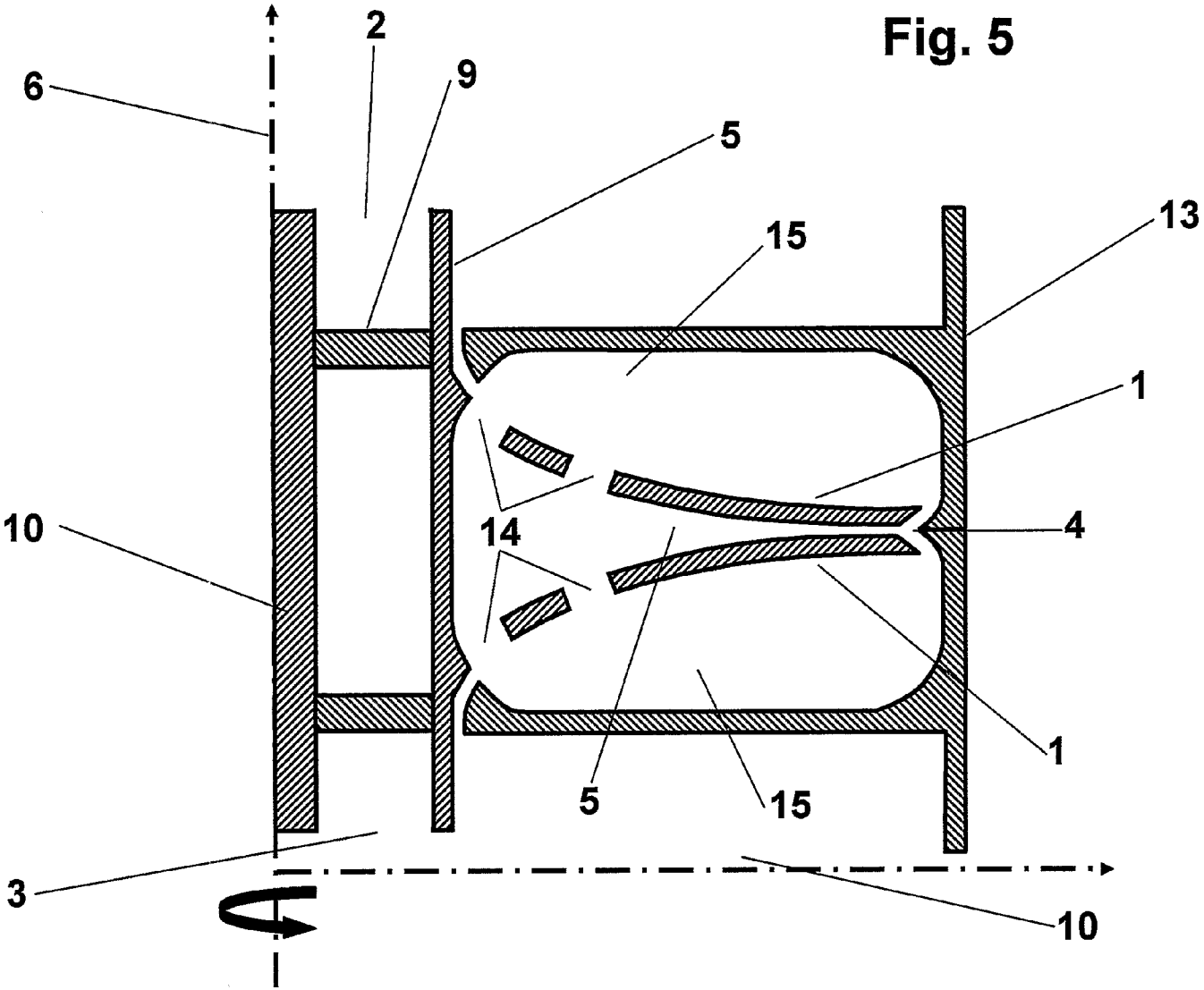
FIG. 5 is a radial-axial cross sectional view of the corotating disk pair comprising a closed centrifugal Bernoulli heat pump.
Figure 6:
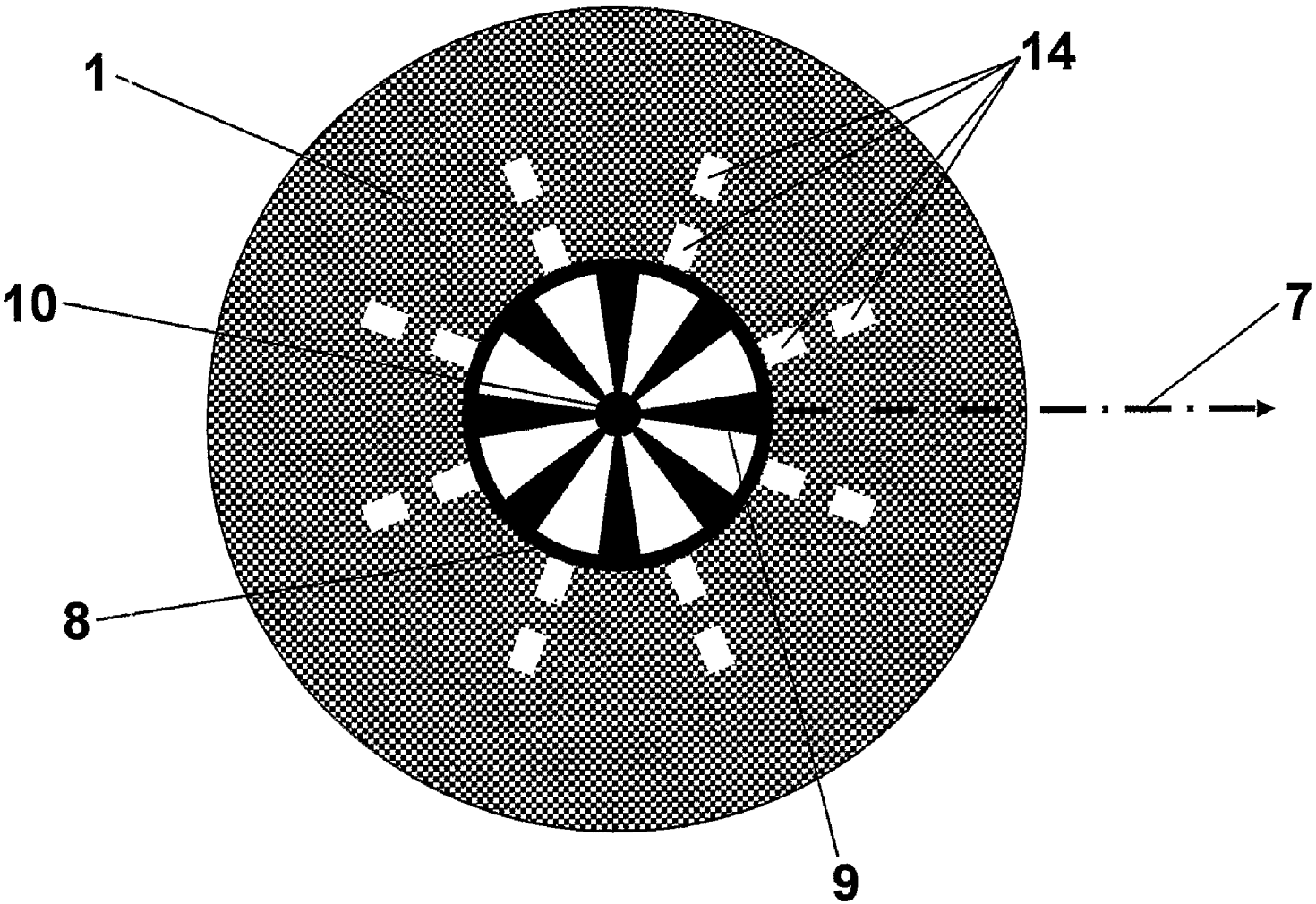
FIG. 6 is a top view of the corotating disk pair shown in FIG. 5

FIG. 5 illustrates a closed embodiment. Here the heat-sink gas flow is continuously recycled, passing through the nozzle over and over again. A virtue of closed embodiments is that they permit the material comprising the heat-sink gas flow to be selected for desirable thermodynamic properties. Closed embodiments require an additional component relative to open embodiments, such as that illustrated in FIG. 1. The additional component is a heat sink to which the heat transferred to the heat-sink flow from the disks is removed by transfer to a conducting heat sink. In FIG. 5, this additional heat sink is provided by the stator 13. Heat transfer from the heat-sink gas flow to the stator occurs where the heat-sink flow has slowed and warmed, as the Bernoulli effect, acting in the reverse direction, converts directed flow motion back into random (thermal) molecular motion. The heat-sink gas flow can be recycled individually for each disk pair or collectively for a number of disk pairs. The embodiment shown in FIG. 5 illustrates individual recycling. That is, heat-sink gas is permanently associated with a particular disk pair. In FIG. 5, the cycling heat-sink flow follows a toroidal path, passing sequentially through regions 5, 4, 15 and 14. The toroidal circulation includes passage through the disks via the perforations 14. Note that heat transfer to the stator can be increased with fins etc. that serve to increase the stator surface area exposed to the slow-and-hot portion of the heat-sink flow. FIG. 6 is a top view of the embodiment shown in FIG. 5, showing the perforations 14 through which the heat-sink gas flows from region 15 to region 5.

Closed embodiments offer several advantages, including the absence of an exhaust, the freedom to cool liquids flowing in the hub and a sink-flow gas selected/designed for its thermodynamic properties.

Figure 7:
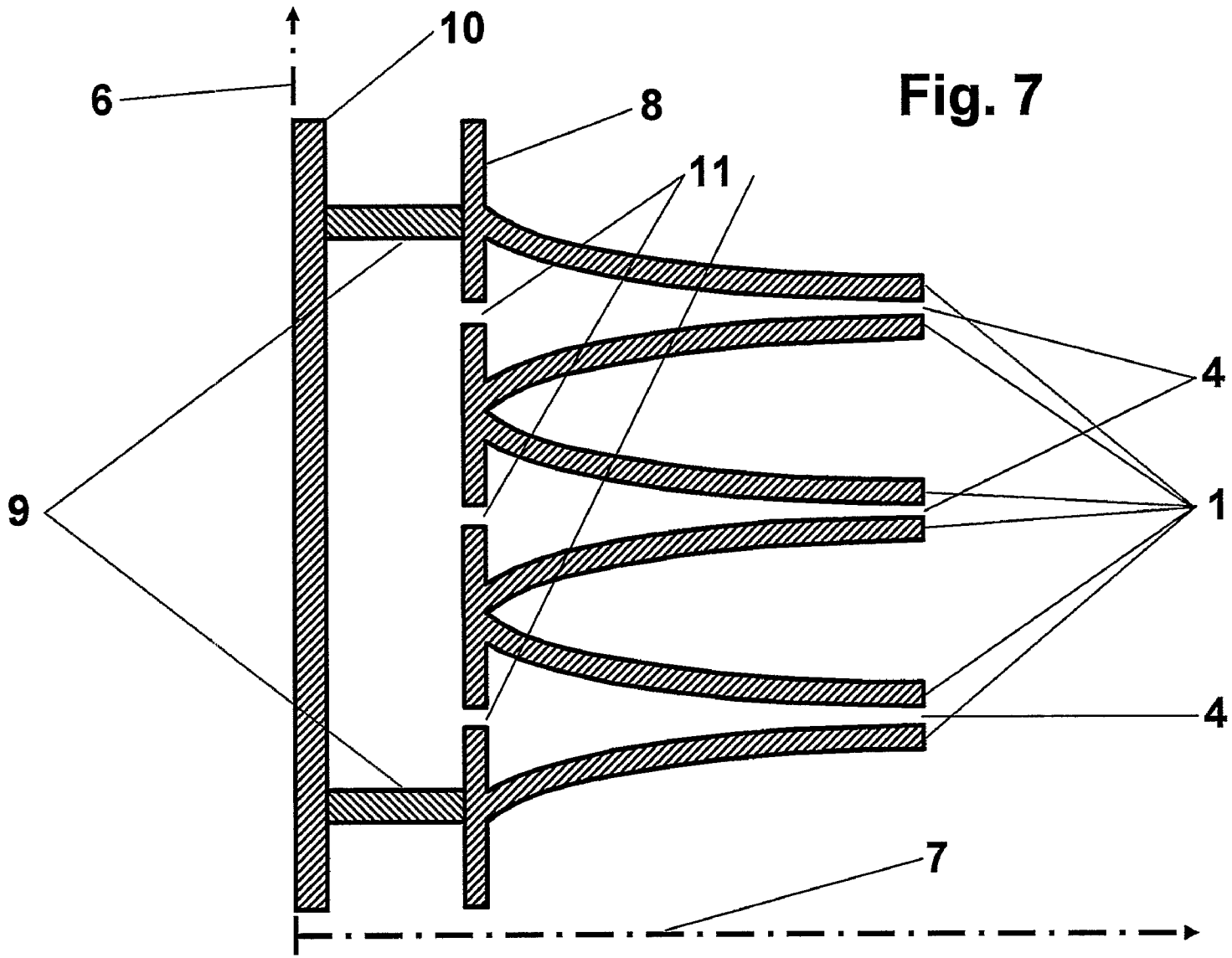
FIG. 7 is a radial-axial cross sectional view of a centrifugal Bernoulli heat pump comprising multiple corotating disk pairs.

FIG. 7 illustrates embodiments consisting of multiple corotating disk pairs mounted on a common hub 8. A multiplicity of disk pairs can be introduced in two different ways, in serial or in parallel. Serial and parallel embodiments provide different benefits. When applied serially, as illustrated in FIG. 7, the result is reduced quantities of source flow cooled to lower temperatures. In serial embodiments, cooled output from a given disk pair becomes input to another disk pair located downstream. In FIG. 7, the heat-sink flow created by gas leaving the axial duct through the perforations 11 is cooled by upstream disk pairs, but the quantity of cooled gas that exits axially at 3 is reduced. When the multiple-pair extension is applied in parallel, the result is different. The temperature of the heat-source fluid is not lowered below that obtained with a single disk pair, but the quantity of source fluid cooled to that temperature is increased. The parallel application of the multiple-disk-pair extension is illustrated by staking multiple disk pairs, such as those shown individually in FIG. 4 on a common hub 8.

Figure 8:
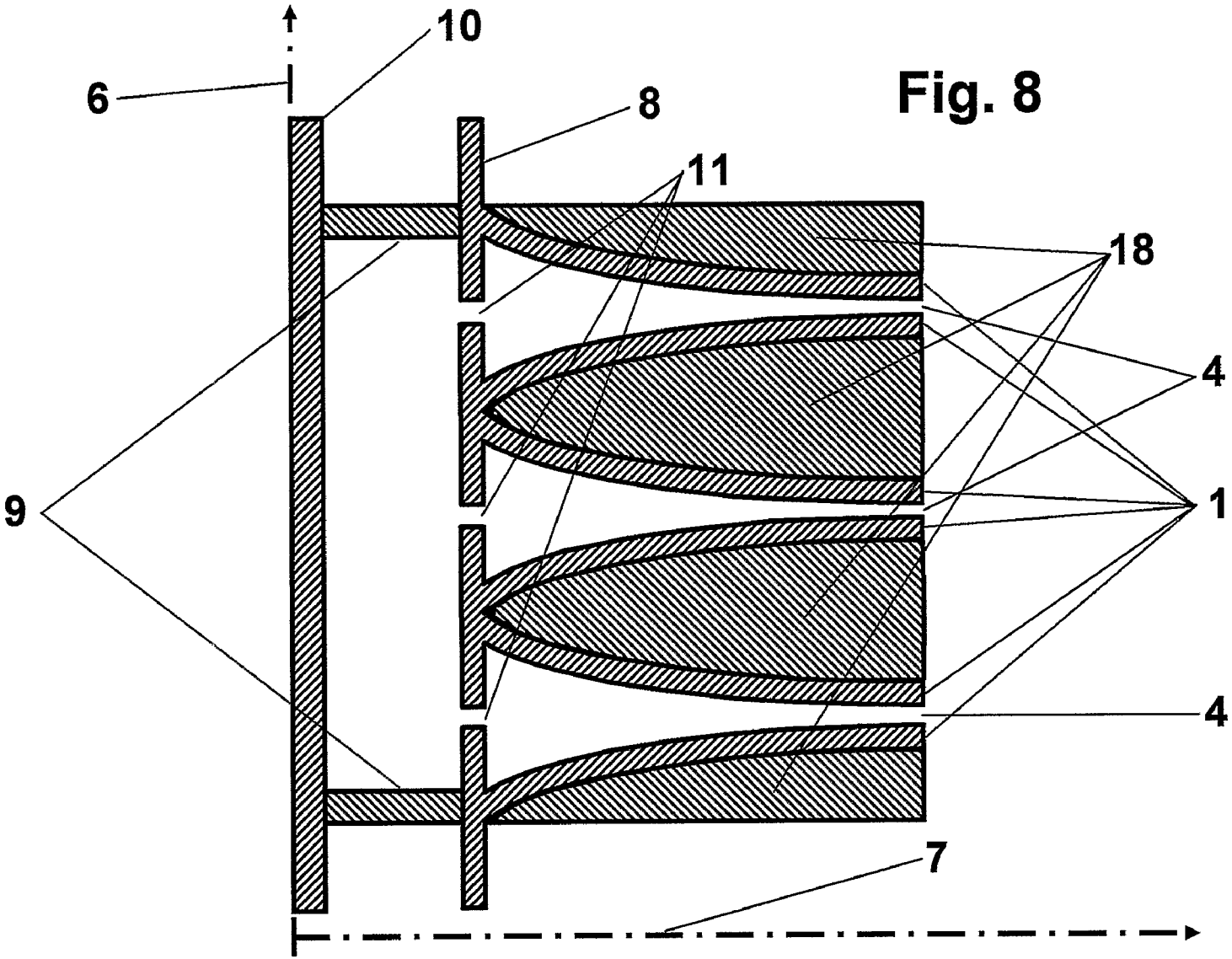
FIG. 8 is a radial-axial cross sectional view of a multiple-disk-pair centrifugal Bernoulli heat pump in which the space between adjacent disk pairs is solid.

FIG. 8 illustrates embodiments in which the space between adjacent disk pairs includes solid material that corotates with the adjacent disk pairs. The material used in this way need only be able to withstand the centrifugal forces implied by the rotation. The benefits of including such material include the reduction in viscous losses implied by the no-slip boundary condition at the rotating surfaces.

The invention claimed is:

1. A heat pump comprising at least one pair of rotatable, thermally-conducting, disks connected together to rotate about a common axis, wherein the distance between opposing surfaces of said disk pair decreases with increasing distance from said common axis, a heat-source fluid-flow channel in good thermal contact with a portion of said disk pair near said common axis, a heat-sink gas-flow channel that is in good thermal contact with a portion of said disk pair away from the axis, a fluid-pump mechanism that maintains a fluid flow through said heat-source fluid-flow channel, and a drive mechanism that rotates said disk pair.

2. A heat pump as in claim 1 wherein the said heat-source fluid flow comprises a gas.

3. A heat pump as in claim 1 wherein the said heat-source fluid flow comprises a liquid.

4. A heat pump as in claim 1 wherein the said heat-sink gas-flow channel is open to the environment.

5. A heat pump as in claim 1 wherein the said heat-sink gas-flow channel and heat-source fluid-flow channel are segregated.

6. A heat pump as in claim 5 wherein the said heat-sink gas-flow channel is closed.

7. A heat pump as in claim 1 wherein a portion of the surface of said disk pair is a poor conductor of heat.

8. A heat pump as in claim 1 wherein at least two said disk pairs corotate about a common axis.

9. A heat pump as in claim 8 further comprising a solid material positioned between adjacent disk pairs and wherein said solid material corotates with said disk pairs.

10. A method for moving heat from a heat source to a higher temperature heat sink, the method comprising the steps of a rotating a coaxial pair of thermally conducting disks shaped so that the distance between opposing disk surfaces decreases with increasing distance from the rotation axis, accelerating a heat-sink gas radially, by centrifugal force applied to said heat-sink gas by the disk surfaces, through the nozzle formed by the converging disk surfaces, cooling a portion of said heat-sink gas to a temperature below that of said heat source by the Bernoulli effect acting in said heat-sink gas where said heat-sink gas has been nozzled to high speed by said disks, transferring heat from said heat source to said cold portion of said heat-sink gas by said thermally conducting disks, which are in good thermal contact with both said heat source and said cold portion of said heat sink.

11. A method, as in claim 10, comprising the additional step of segregating said heat-sink gas from said heat source.

12. A method as in claim 11, comprising the additional steps of cooling said heat-sink gas by transferring heat from said fluid heat-sink gas to a second heat sink and directing said heat-sink gas flow so that it recycles through said nozzle.

* * * * *